US009970397B2

(12) United States Patent
Stucchi et al.

(10) Patent No.: US 9,970,397 B2
(45) Date of Patent: May 15, 2018

(54) FUEL ELECTRO-INJECTOR FOR A FUEL INJECTION SYSTEM FOR AN INTERNAL COMBUSTION ENGINE

(71) Applicant: C.R.F. Societa' Consortile per Azioni, Orbassano (IT)

(72) Inventors: Sergio Stucchi, Orbassano (IT); Onofrio De Michele, Orbassano (IT); Raffaele Ricco, Orbassano (IT); Marcello Gargano, Orbassano (IT); Carlo Mazzarella, Orbassano (IT)

(73) Assignee: C.R.F. Societa' Consortile per Azioni, Orbassano (IT)

( * ) Notice: Subject to any disclaimer, the term of this patent is extended or adjusted under 35 U.S.C. 154(b) by 38 days.

(21) Appl. No.: 14/518,626

(22) Filed: Oct. 20, 2014

(65) Prior Publication Data

US 2015/0108246 A1 Apr. 23, 2015

(30) Foreign Application Priority Data

Oct. 21, 2013 (EP) ..... 13189601

(51) Int. Cl.
*B05B 1/08* (2006.01)
*F02M 51/06* (2006.01)
(Continued)

(52) U.S. Cl.
CPC ..... *F02M 51/0603* (2013.01); *F02M 61/08* (2013.01); *F02M 61/12* (2013.01);
(Continued)

(58) Field of Classification Search
CPC .... F02M 51/0603; F02M 61/08; F02M 61/12; F02M 63/0073; F02M 2200/703; F02M 2200/705; F02M 61/047
(Continued)

(56) References Cited

U.S. PATENT DOCUMENTS 6,119,952 A 9/2000 Kappel et al.
6,216,964 B1 * 4/2001 Lambert ..... F02M 51/0603 239/533.12
(Continued)

FOREIGN PATENT DOCUMENTS

DE 199 05 152 C1 7/2000
DE 102 17 594 A1 11/2003
(Continued)

*Primary Examiner* — Arthur O Hall
*Assistant Examiner* — Adam J Rogers
(74) *Attorney, Agent, or Firm* — Blank Rome LLP

(57) ABSTRACT

A fuel electro-injector for a fuel injection system for an internal combustion engine, having an atomizer equipped with a nozzle and a valve needle defining a discharge section that is annular and has a width that continuously increases as the opening stroke of the valve needle proceeds. The opening stroke is directed outwards and is caused, in a proportional manner, by the operation of an electric actuator. The electro-injector has a high-pressure environment with an annular passageway around the lateral outer surface of the valve needle to supply fuel to the discharge section, and a low-pressure environment, which communicates with a fuel outlet and is separated from the high-pressure environment by a dynamic seal between the valve needle and the nozzle. The electro-injector is provided with a hydraulic connection between the electric actuator and the valve needle, with a pressure chamber axially delimited, on one side, by the valve needle and, in use, is filled with fuel that, once compressed, axially pushes the valve needle along the opening stroke. The hydraulic connection is placed in the low-pressure environment, so that the pressure chamber only communicates with this environment.

16 Claims, 7 Drawing Sheets

(51) Int. Cl.
*F02M 61/08* (2006.01)
*F02M 61/12* (2006.01)
*F02M 63/00* (2006.01)

(52) U.S. Cl.
CPC ... *F02M 63/0073* (2013.01); *F02M 2200/703* (2013.01); *F02M 2200/705* (2013.01)

(58) Field of Classification Search
USPC ..... 239/102.2
See application file for complete search history.

(56) References Cited

U.S. PATENT DOCUMENTS 6,224,001 B1 * 5/2001 Cooke ..... F02M 51/0603 239/533.11
6,969,009 B2 * 11/2005 Bachmaier ..... F02M 51/0603 239/102.2
7,044,407 B2 * 5/2006 Fischer ..... F02M 51/0603 239/453
7,055,765 B2 * 6/2006 Liskow ..... F02M 51/0603 239/533.2
7,204,434 B2 * 4/2007 Pasquali ..... F02M 51/06 239/456
7,309,032 B2 * 12/2007 Fischer ..... F02M 51/0603 239/102.1
2003/0201344 A1 * 10/2003 Wark ..... F02M 47/00 239/533.8
2004/0074999 A1 * 4/2004 Haag ..... F02M 51/0603 239/585.1
2005/0017096 A1 * 1/2005 Bachmaier ..... F02M 51/0603 239/584
2006/0283424 A1 * 12/2006 Nagatomo ..... F02M 45/086 123/467
2008/0099585 A1 * 5/2008 Ohata ..... F02M 47/027 239/585.5
2010/0162992 A1 * 7/2010 Ricco ..... F02M 47/027 123/299
2010/0288239 A1 * 11/2010 Morris ..... F02M 51/0603 123/494
2014/0000565 A1 * 1/2014 Schurz ..... F02M 55/02 123/472

FOREIGN PATENT DOCUMENTS

FR 2 941 745 A3 8/2010
FR 2 941 746 A1 8/2010
JP 2008-151043 A 7/2008
WO WO 03/012283 A1 2/2003

* cited by examiner

FUEL ELECTRO-INJECTOR FOR A FUEL INJECTION SYSTEM FOR AN INTERNAL COMBUSTION ENGINE

FIELD OF THE INVENTION

The present invention relates to a fuel electro-injector, in particular of the piezoelectric or magnetostrictive actuation type, for a high-pressure fuel injection system for an internal combustion engine. In particular, the present invention refers to a fuel electro-injector for a fuel injection system of the common rail type for a diesel cycle engine.

DESCRIPTION OF THE RELATED ART

In diesel cycle engines, a need is felt to reduce the formation of particulate and nitrogen oxides, by trying to make the air-fuel charge as homogeneous as possible in the engine combustion chamber and therefore limiting the diffusive nature of combustion.

In other words, as also mentioned in US2008245902A1, research is aimed at building an internal combustion engine of the HCCI (Homogeneous Charge Compression Ignition) type.

However, to all intents and purposes, the current technology does not allow an engine that is capable of operating with a homogeneous charge in all operating load conditions to be built in a relatively simple and inexpensive manner.

Instead, it is reasonable to be able to build an engine that is able to operate with a so-called mixed mode, namely in an HCCI mode (or a mode close to HCCI) at low and medium operating loads, and in a so to speak "traditional" mode at high operating loads.

To go towards this direction, it is necessary to make a fuel injector that not only achieves high-precision fuel metering in all operating conditions, but is also extremely flexible to obtain:

- high fuel atomization and therefore high charge homogeneity at the moment of combustion at low and medium operating loads, and
- high fuel penetration in the combustion chamber at high operating loads.

At the injector atomizer, US2008245902 teaches to use a single needle that moves under the action of an actuator for opening and closing a nozzle, which has two series of micro-holes, for forming a variable discharge section depending on the needle lift.

This configuration with various series of micro-holes enables obtaining different grades of fuel atomization and different SMDs (Sauter Mean Diameter), according to the optimal combustion conditions defined for the different operating loads.

However, there are some drawbacks. First of all, the micro-holes can be subject to the depositing of carbonaceous residues, commonly known as "coking", which compromises the homogeneity of the various fuel jets and the metering of the fuel, to the point of actually clogging the micro-holes.

In addition, the above-stated micro-holes are placed downstream of the sealing zone provided between needle and nozzle, such that they contain a certain volume of fuel when the nozzle is closed: this fuel can pass from the micro-holes to the combustion chamber in response to a depression in the combustion chamber and therefore give rise to metering a different amount of fuel from that desired.

Furthermore, the opening of the nozzle and, in consequence, the discharge section for fuel injected into the combustion chamber varies in a discrete manner, depending on the injection needle lift, and so the flexibility of this injector is not optimal.

To remedy these drawbacks, it is preferable to use an injector in which the atomizer is devoid of micro-holes and has a needle of the so-called pintle type, i.e. an outwardly opening nozzle type. Another detail of this type of atomizer is that the nozzle is opened by pushing the needle by a piezoelectric or magnetostrictive actuator. A solution of this type is described, for example, in EP1559904.

In this solution, the electric command signal supplied to the actuator causes a proportional lengthening or shortening of the actuator, and this lengthening/shortening causes, in turn, a translation of the needle. It is evident that the axial position of the needle and therefore of the fuel discharge section varies continuously, and not discretely, according to the electric command signals supplied to the actuator.

The solution described in EP1559904 is a direct action one. In other words, the lengthening/shortening of the actuator causes an identical axial movement of the needle, without any possibility of compensating:

- variations in axial length of the needle due to the thermal gradients that normally arise between engine starting conditions and normal running conditions, and
- variations in axial length of the needle due to the different fuel pressure in the various engine operating points (the pressure of the fuel acts both radially, in compression and therefore like a choke, and axially, in traction, such that the increase in pressure tends to cause a lengthening of the needle);
- inevitable axial play due to wear on the components, machining tolerances, assembly inaccuracies, etc.

These factors, namely the axial play and dimensional variations of the needle along its axis, tend to have such a significant percentage effect on the total stroke of the needle as to compromise the precision of the degree of nozzle opening and therefore of metering fuel into the combustion chamber. For example, considering a piezoelectric actuator of a size suitable for being installed in normal fuel injectors, its lengthening/shortening can have a magnitude of approximately 40-60 μm, while the above-stated factors can result in a needle positioning error of approximately 40 μm. It is therefore evident that with the solution of EP1559904, it is not possible to calibrate the fuel discharge section with precision and, consequently, neither the amount of fuel to inject.

At least some of these drawbacks can be overcome by axially interposing a hydraulic connection, namely a chamber filled with fuel, between the needle and the actuator. This chamber compensates the play in the assembly phase and has a volume that can vary in dynamic conditions to also compensate for the needle dimensional variations.

A solution of this type, for example, is described in US2011232606A1, which corresponds to the preamble of claim 1. This prior art document discloses a piston that, under the direct action of a piezoelectric actuator, moves with a reciprocating motion for compressing and expanding the volume of a pressure chamber defining a hydraulic connection, which operatively connects the piston to the needle. The pressure chamber has variable axial length to compensate for play and thermal variations. Furthermore, the sizing provided for the faces of the needle and the piston, which axially delimit the pressure chamber, enables advantageously amplifying the displacement of the needle with respect to the one of the piston.

However, this solution has some drawbacks, too.

First of all, to be injected into the combustion chamber, the fuel passes through an axial passage made in the needle and exits through a series of micro-holes which are made in the tip of the needle and which tend to have the same above-mentioned coking phenomena.

In addition, this configuration causes two fuel pressure drops in series in low-load engine operation (see FIG. 2 of US2011232606A1), i.e. at the above-stated micro-holes and the restriction of the discharge section between the needle and the nozzle of the atomizer. Thus, in order to achieve the desired atomization at low loads, it is necessary to supply the fuel at a higher pressure with respect to the case where there is only a single pressure drop.

Furthermore, the fuel pressure in the axial passage can cause radial expansion of the needle, with the consequent risk of the needle seizing in the inner seat of the atomizer nozzle.

In addition, the pressure chamber is filled with fuel coming from the fuel supply inlet and so the pressure in the pressure chamber, as well as being relatively high, is also variable in response to variations in supply pressure when the engine is running.

This pressure variation in the pressure chamber of the hydraulic connection is undesired, as it negatively affects the positioning precision of the needle.

Furthermore, the solution described in US2011232606A1 does not have characteristics such as to be able to automatically vary the volume of the pressure chamber in response to relatively rapid changes in length of the needle, which are generally due to pressure variations in the fuel around the needle and pressure variations in the combustion chamber.

SUMMARY OF THE INVENTION

The object of the present invention is that of providing a fuel electro-injector for a fuel injection system for an internal combustion engine, which enables the above-described problems to be solved in a simple and inexpensive manner, and preferably provides expedients to avoid undesired opening of the nozzle.

According to the present invention, a fuel electro-injector for a fuel injection system for an internal combustion engine is provided, as defined in claim 1.

BRIEF DESCRIPTION OF THE DRAWINGS

For a better understanding of the present invention some preferred embodiments will now be described, purely by way of non-limitative example and with reference to the attached drawings, where.

DETAILED DESCRIPTION OF PREFERRED EMBODIMENTS OF THE INVENTION

The present invention will now be described in detail with reference to the attached figures to enable a skilled man in the art to make and use it.

Figure 1:
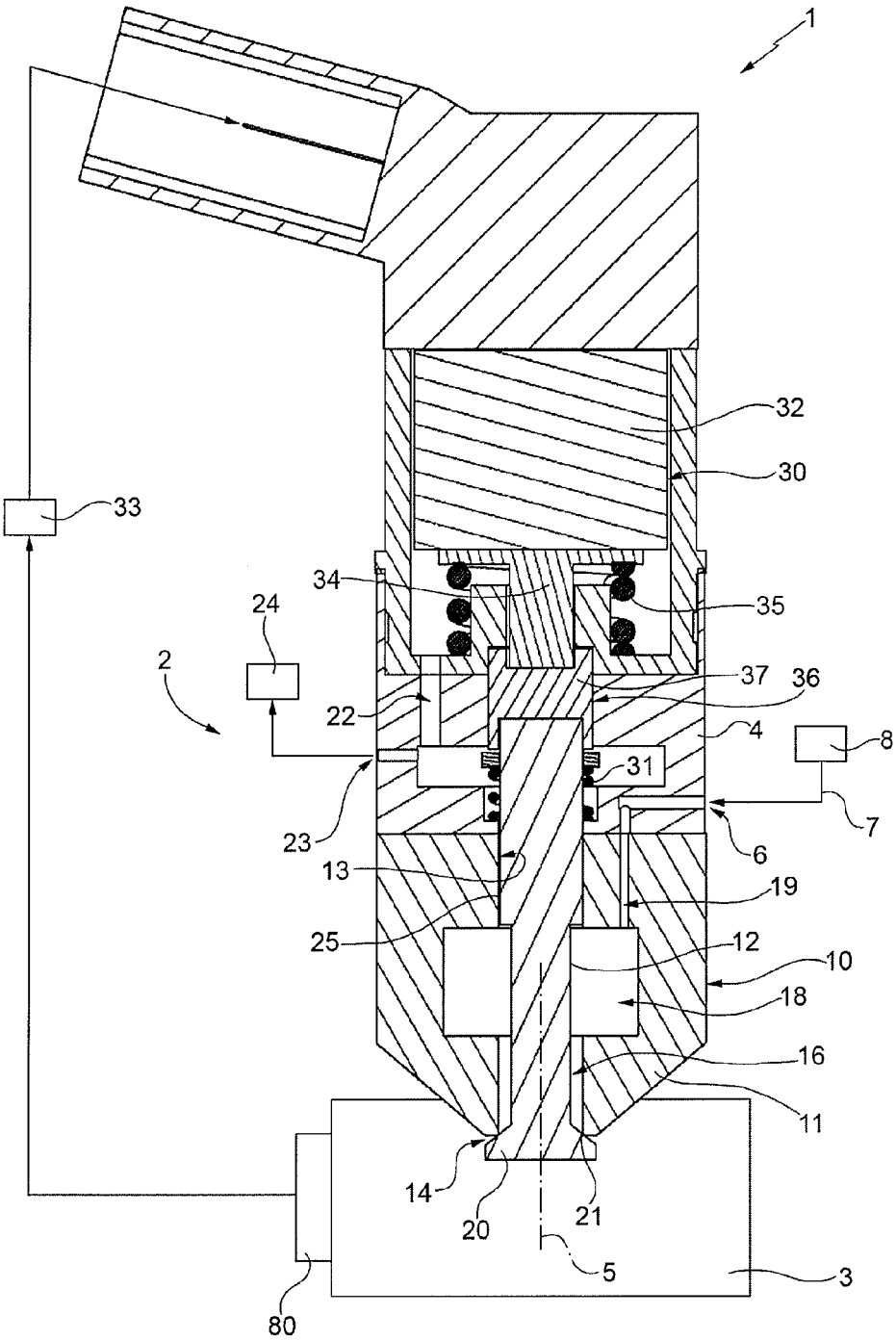
FIG. 1 is a diagram showing a first preferred embodiment of the fuel electro-injector for a fuel injection system for an internal combustion engine, according to the present invention.

In FIG. 1, reference numeral 1 indicates, as a whole, a (schematically shown) fuel electro-injector forming part of a high-pressure fuel injection system, indicated by reference numeral 2, for injecting fuel into a (schematically shown) combustion chamber 3 of an internal combustion engine. In particular, the injection system 2 is of the common rail type, for a diesel-cycle internal combustion engine.

The electro-injector 1 comprises an injector body 4 (FIG. 2), which extends along a longitudinal axis 5, is preferably formed by a number of pieces fastened together, and has an inlet 6 to receive fuel supplied at high pressure, in particular at a pressure in the range between 600 and 2800 bar. In particular, the inlet 6 is connected via a supply line 7 to a common rail 8, which in turn is connected to a high-pressure pump (not shown), also forming part of the injection system 2.

The electro-injector 1 ends with a fuel atomizer 10 comprising a nozzle 11 fastened to the injector body 4 and a valve needle 12, which extends along axis 5 and is axially movable in a through seat 13 for opening/closing the nozzle 11, by performing an opening stroke directed axially outwards from the seat 13 and a closing stroke directed inwards, namely towards the injector body 4.

Given this movement configuration, this type of electro-injector 1 is generally referred to as an "outwardly opening nozzle type", or a "pintle".

The nozzle 11 comprises a sealing zone 21, which, together with a head 20 of the valve needle 12, defines a discharge section 14 for the fuel. The discharge section 14 has a circular ring-like shape, with a width that is constant along the circumference, but continuously increases as the opening stroke of the valve needle 12 proceeds.

The fuel is thus injected into the combustion chamber 3 with a spray that is homogeneous along the circumference, i.e. a conical or "umbrella" spray, and with a variable flow rate, proportional to the stroke of the valve needle 12.

In particular, the sealing zone 21 is defined by a conical or sharp-edged surface, with a circular ring-like shape, at the outlet of the seat 13.

The head 20 has an external diameter greater than that of the sealing seat 21 and the remainder of the valve needle 12 and, near the nozzle 11, is delimited by a conical or hemispherical surface suitable for shutting against the sealing seat 21. These two components, when mated in contact, define a single "static seal", i.e. a seal that guarantees perfect closure of the nozzle 11.

As mentioned above, the sealing seat 21 and the valve needle 12 are sized for defining a discharge section 14 that varies continuously, and not in a step-wise discrete manner, as the axial position of the valve needle 12 varies. In particular, when starting from the closed position, in which the head 20 rests against the sealing seat 21 and the nozzle 11 is therefore closed, the outward opening stroke of the valve needle 12 causes an initial opening of the nozzle 11 and then a progressive increase in the discharge section 14 for the fuel.

Therefore, with a relatively small opening stroke, the discharge section 14 is also relatively small, and so the fuel is injected with high atomization. With a relatively long opening stroke, the discharge section 14 is also relatively long: thus, also considering the particular geometry of the head 20, the fuel is injected with high penetration. This variability of the discharge section 14 can be advantageous in implementing an engine operating mode of the mixed type, namely an HCCI-type (Homogeneous-Charge Compression-Ignition) mode at low and medium loads, with high fuel atomization in the combustion chamber 3, and a traditional CI-type (Compressed ignition) mode at high loads, with high fuel penetration in the combustion chamber 3.

Always with reference to the diagram in FIG. 1, the atomizer comprises an annular passageway 16, which is defined between the lateral outer surface of the valve needle 12 and an inner surface of the nozzle 11 and axially ends at the seal seat 21, so that the fuel can be injected into the combustion chamber 3. The annular passageway 16 defines a passage section that is sufficiently large to limit pressure drops in the nozzle 11 to a minimum. Thus, high-pressure fuel does not flow through any micro-holes and the amount of fuel injected depends exclusively on the size of the discharge section 14 and the pressure difference between the annular passageway 16 and the combustion chamber 3.

The annular passageway 16 runs from the annular chamber 18, which is also defined between the lateral outer surface of the valve needle 12 and the inner surface of the nozzle 11 and communicates with the inlet 6 through a passage 19 inside the injector body 4.

Still with reference to FIG. 1, the chamber 18 and the annular passageway 16 define a high-pressure environment, as they communicate with the inlet 6. The injector body 4 also has a low-pressure environment 22, which communicates with an outlet 23 connected to the lines 24 that return fuel to a fuel tank (not shown) and which are at a low pressure, for example, approximately 2 bar.

The high-pressure environment (16,18) and the low-pressure environment 22 are separated by a so-called "dynamic seal" defined by a coupling zone 25 between the valve needle 12 and a fixed guide portion that, in particular, forms part of the nozzle 11. In general, the term "dynamic seal" is to be intended as a sealing zone defined by a shaft/hole type of coupling, with sliding and/or a guide between the two components, where play in the diametrical direction is sufficiently small to render the amount of fuel that seeps through to be negligible.

In other words, a relatively small amount of fuel seeps from the chamber 18 to the low-pressure environment 22: this fuel flows to the outlet 23 to return to the fuel tank.

Preferably, the mean diameter of the static seal between the head 20 and the sealing seat 21 is equal to the diameter of the coupling zone 25, to ensure the axial balancing of the valve needle 12 with respect to pressure when the nozzle 11 is closed.

Preferably, the valve needle 12 is made in one piece. Instead, in the example shown in FIGS. 2 to 4, the valve needle 12 is defined by two distinct parts arranged in axial contact with each other. In other words, the valve needle 12 is composed of a needle 27, forming part of the atomizer 10, and a transmission rod 28 arranged in the injector body 4, in particular entirely within the low-pressure environment 22.

To cause translation of the valve needle 12, the electro-injector 1 comprises an actuator device 30, in turn comprising an electrically-controlled actuator 32, i.e. an actuator controlled by an electronic control unit 33 that, for each step of injecting fuel and the associated combustion cycle in the combustion chamber 3, is programmed to supply the actuator with one or more electric command signals to perform corresponding injections of fuel. In particular, the injection system 2 comprises a pressure transducer 80, which is mounted for detecting the pressure in the combustion chamber 3, and then send a corresponding signal to the electronic control unit 33. The electronic control unit 33 controls the actuator 32 with feedback, based on the signal of the detected pressure and other signals regarding the engine operation.

The type of actuator 32 can be such as to define an axial displacement proportional to the electric command signal received: for example, the actuator 32 could be defined by a piezoelectric actuator or by a magnetostrictive actuator. The actuator device 30 further comprises a spring 35, which is preloaded to exert axial compression on the actuator 32 to increase efficiency.

The excitation given by the electric command signal causes a corresponding axial extension of the actuator 32 and consequently a corresponding axial translation of a piston 34, which is coaxial and fixed with respect to an axial end of the actuator 32. In the particular example shown in FIG. 4, the same spring 35 holds the piston 34 in a fixed position with respect to the actuator 32.

The axial translation of the piston 34 pushes on the valve needle 12 and consequently causes the opening of the nozzle 11, against the action of a spring 31 that is preloaded to axially push the valve needle 12 inwards and consequently to close the nozzle 11.

Figure 3:
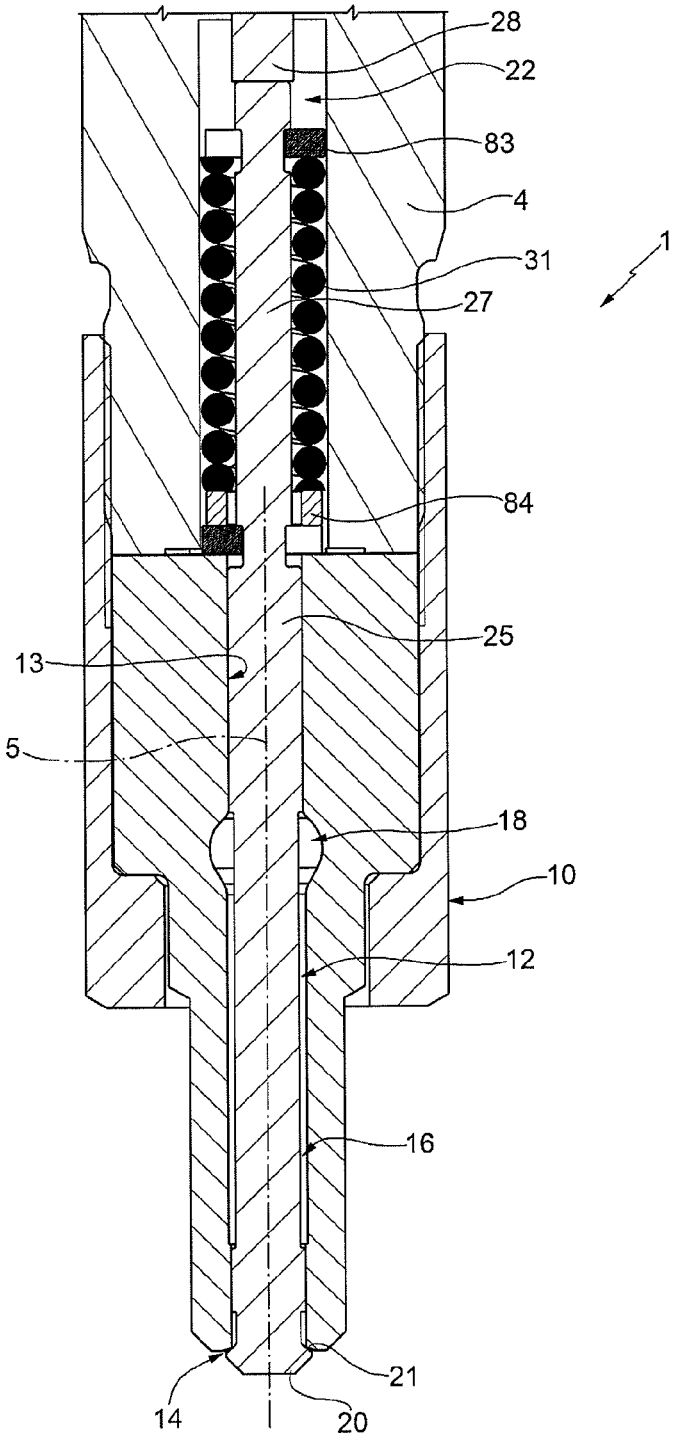
FIGS. 3 and 4 are enlargements of two details in FIG. 2.

In particular, as can be seen in FIG. 3, the spring 31 is arranged axially between the nozzle 11 and an end portion of the needle 27. Preferably, on one side, the spring 31 rests axially against a half-ring 83 that engages the end portion of the needle 27 and, on the other side, against a spacer 84, which in turn rests against the nozzle 11. The axial thickness of the spacer 84 can be opportunely chosen to adjust the preloading of the spring 31. The half-ring 83 is simply slipped on the needle 27, or is fastened to the needle 27, for example by welding or interference fitting.

Preferably, the spring 31 is arranged in a portion of the low-pressure environment 22, around valve needle 12 and axially between the hydraulic connection 36 and the coupling zone 25.

Figure 4:
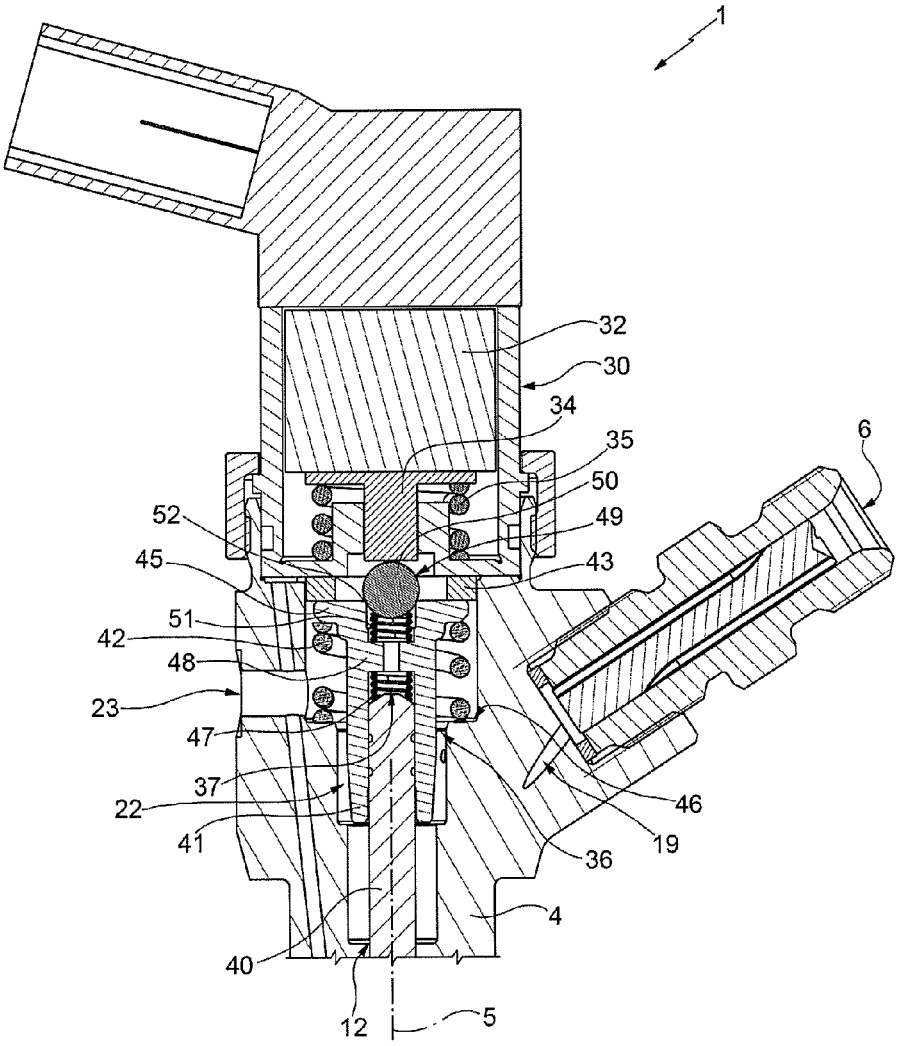

In the embodiment in FIG. 4, the piston 34 is defined by a pin.

Figure 5:
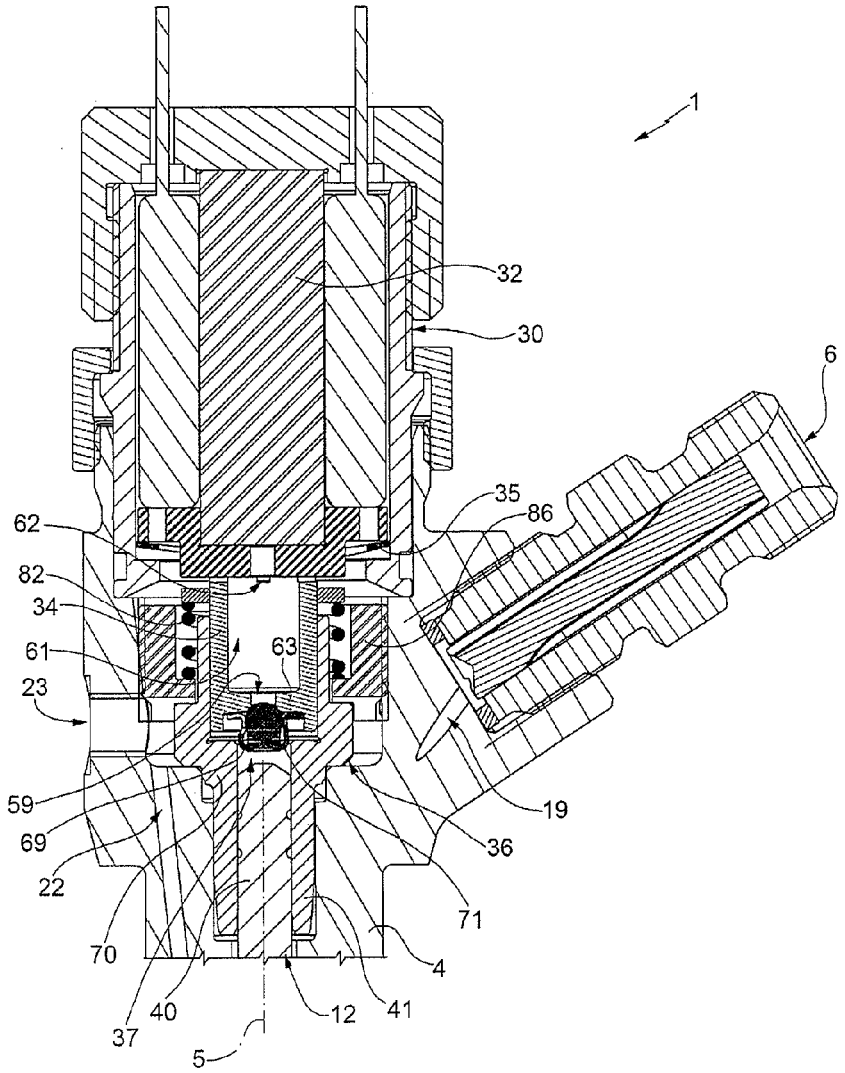
FIG. 5 is similar to FIG. 4 and shows a third preferred embodiment of the fuel electro-injector according to the present invention.

Instead, in the embodiment in FIG. 5, the piston 34 is hollow inside. Furthermore, in FIG. 5, a spring 82 is provided in addition to spring 35 for keeping the piston 34 axially against the axial end of the actuator 32, defined, for example, by a plate.

As illustrated in FIG. 1, the actuator 32 is coupled to the valve needle 12 by a hydraulic connection 36. The hydraulic connection 36 comprises a pressure chamber 37, which is coaxial with the valve needle 12 and the piston 34 and is filled with fuel that, once compressed, transmits the axial thrust from the piston 34 to the valve needle 12. The amount of fuel in the pressure chamber 37 varies automatically for compensating the axial play and dimensional variations of the valve needle 12 during operation, as will be explained in greater detail hereinafter. According to one aspect of the present invention, the pressure, chamber 37 can only communicate with the low-pressure environment 22, for being filled with fuel at low pressure, and is consequently insensitive to the pressure variations normally present in the high-pressure environment 16,18.

Figure 2:
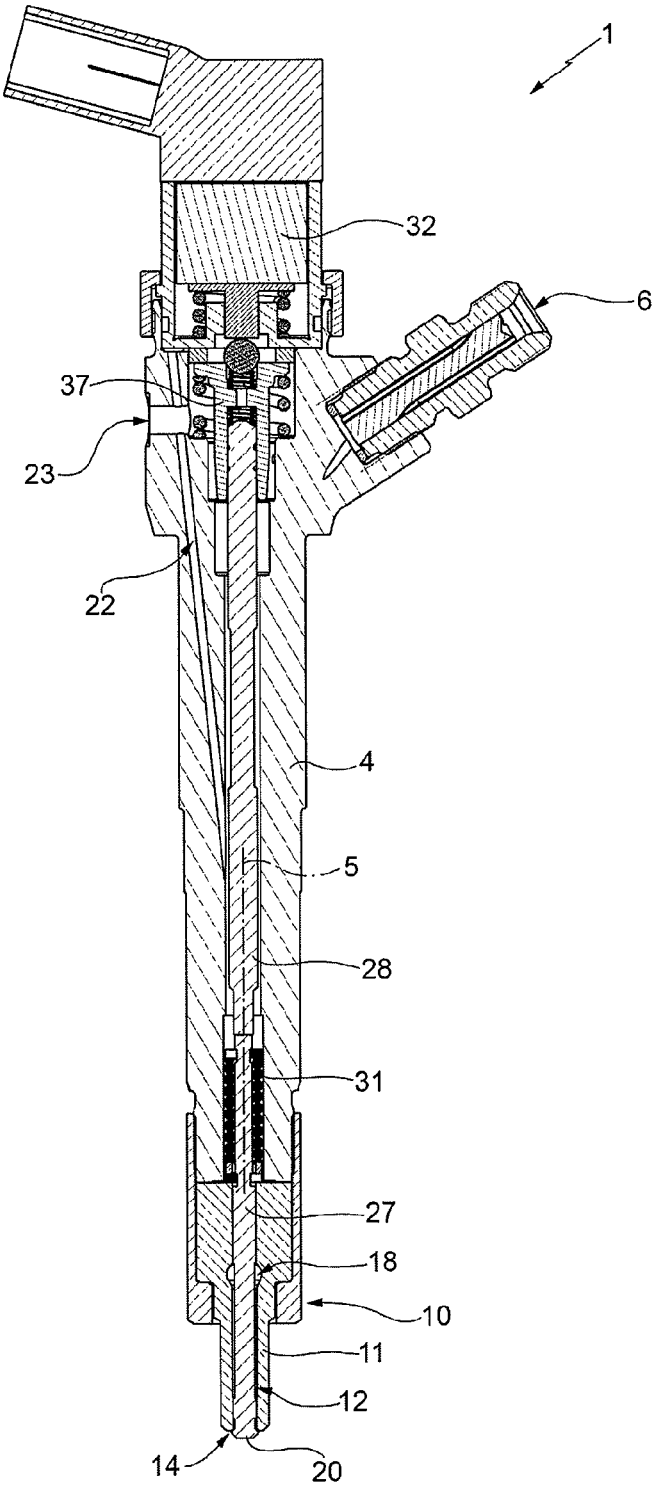
FIG. 2 shows, in cross-section and in a simplified manner, a second preferred embodiment of the fuel electro-injector according to the present invention.

As can be seen in FIGS. 2, 4 and 5, the pressure chamber 37 is axially delimited, on one side, directly by an axial tip 40 of the valve needle 12.

In the embodiment in FIG. 4, the hydraulic connection 36 comprises a sleeve 41, which laterally delimits the pressure chamber 37, is surrounded by the low-pressure environment 22, is engaged in an axially sliding manner by the tip 40 and is guided by the tip 40 so that it can move axially with respect to the injector body 4. The guide zone between the tip 40 and the sleeve 41 defines a dynamic seal, intended in the sense defined in the foregoing.

The sleeve 41 is axially pushed by a spring 42 for axially resting against a fixed shoulder, defined in particular by a spacer 43 arranged between the sleeve 41 and the actuator 32 and having a thickness that can be chosen in an opportune manner.

In particular, the sleeve 41 axially ends with an outer flange 45 having one axial side resting against the spacer 43, while the spring 42 is arranged axially between the other side of the flange 45 and an axial shoulder 46 of the injector body 4, in the low-pressure environment 22.

In the case shown, in which the valve needle 12 is formed by two parts (needle 27 and rod 28), the hydraulic connection 36 comprises a spring 47 that is housed in the pressure chamber 37, axially rests against the rod 28 on one side, and against an inner flange 48 of the sleeve 41 on the other side, for pushing the rod 28 against the needle 27.

On the axial part facing the actuator 32, the pressure chamber 37 has an aperture 49 suitable for being opened/closed by a plug 50.

The maximum passage section for the fuel defined by the aperture 49 and the plug 50 is greater than that of the dynamic seal between the tip 40 and the sleeve 41.

The aperture 49 is defined by an end rim of the sleeve 41 and is open when the nozzle 11 is closed and the actuator 32 is de-energized, thus placing the pressure chamber 37 in communication with the low-pressure environment 22.

The plug 50 hermetically closes the aperture 49 in response to operation of the actuator 32, when starting from a condition in which the latter is de-energized, as will be explained in greater detail hereinafter.

The plug 50 is external to the pressure chamber 37 and, preferably, is a piece separate and movable with respect to the piston 34 and is axially pushed against piston 34 by a spring 51. The plug 50 axially faces the aperture 49 and is configured for making contact with a sealing seat 52 of the sleeve 41 to close and fluidically seal the aperture 49 under the thrust of the piston 34 when driven by the actuator 32.

In particular, the spring 51 axially rests with one side against the plug 50 and the other side against the flange 48. Preferably, the plug 50 is defined by a ball.

Figure 6:
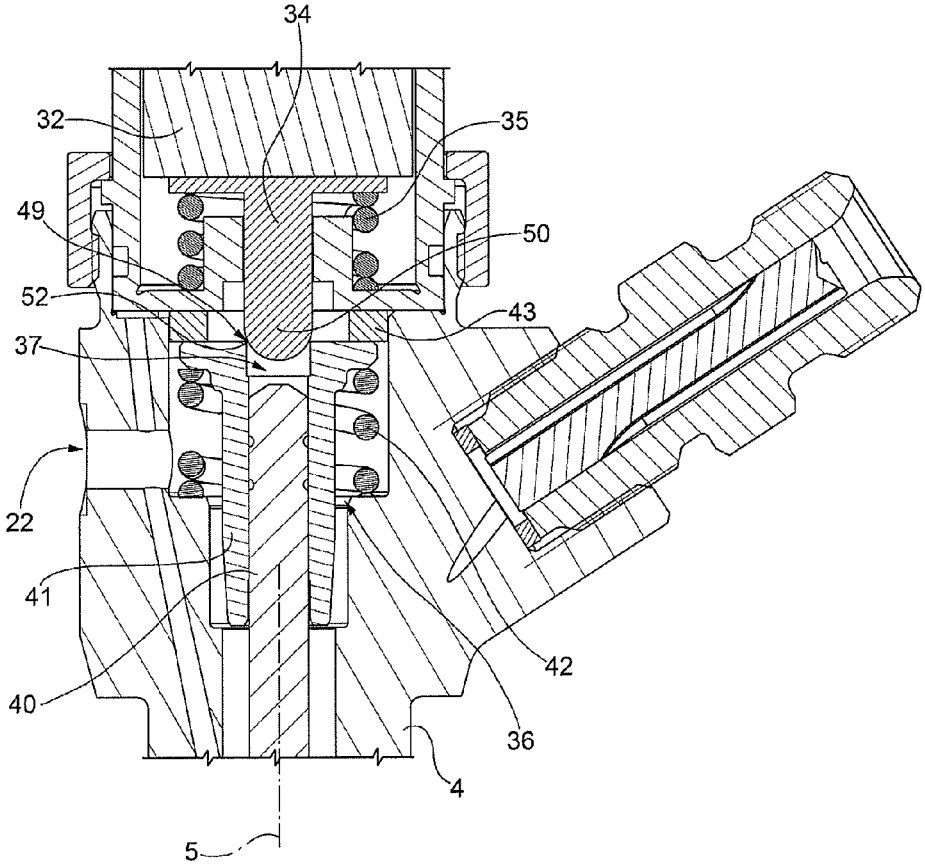
FIGS. 6 and 7 are similar to FIG. 4 and show respective variants of the electro-injector in FIG. 2.

According to the variant in FIG. 6, the plug 50 is fastened to or made in one piece with the piston 34, for avoiding using spring 51. For example, the plug 50 could define a semi-spherical end of the piston 34. In any case, the plug 50 can have different shapes, but always configured to mate with the sealing seat 52 and close the aperture 49.

Figure 7:
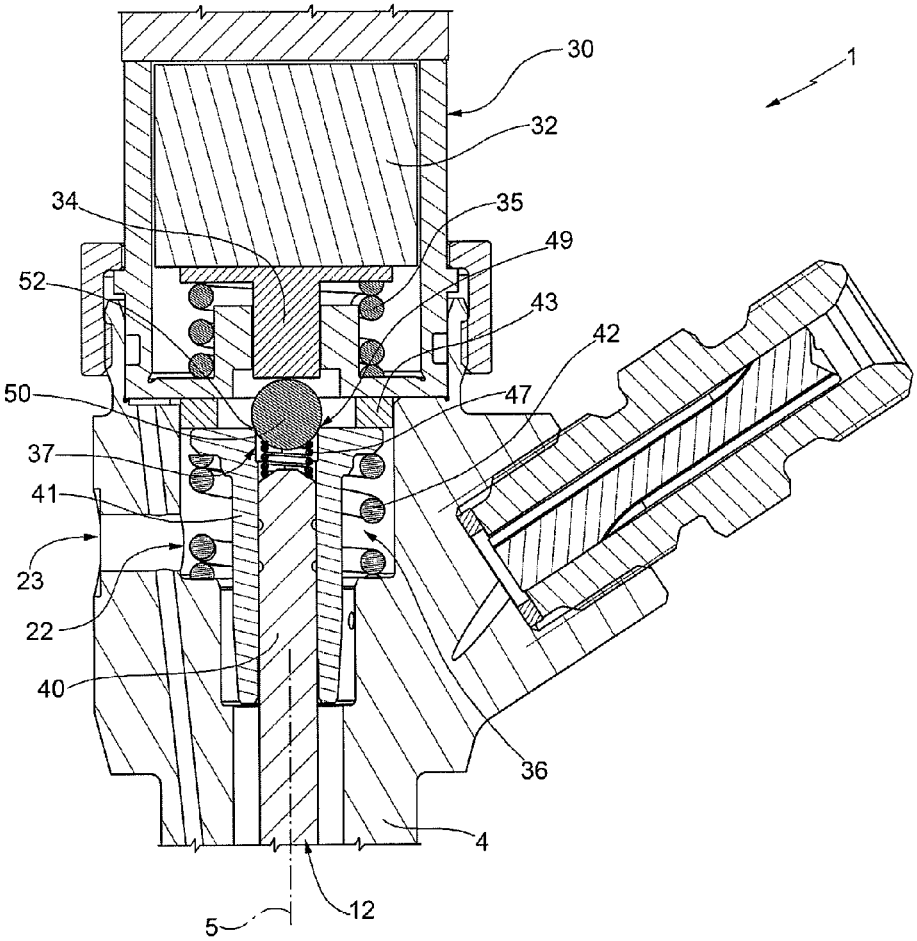

According to a further variant shown in FIG. 7, it is possible to eliminate spring 51 and flange 48, keeping the plug 50 against the piston 34 via spring 47.

As mentioned above, when the actuator 32 is not energized, springs 42 and 47 respectively keep the sleeve 41 in contact against the spacer 43 and the rod 28 in contact against the needle 27, while spring 51 keeps the plug 50 in a position axially set apart from the sealing seat 52, against the piston 34. Moreover, in this operating condition, the thrust of spring 31 keeps the nozzle 11 closed, as mentioned above.

The distance of the plug 50 from the sealing seat 52 depends on the thickness of the spacer 43, which therefore allows adjusting the maximum discharge section through the aperture 49 in the design and/or assembly phase.

Starting from this operating condition and through a successive excitation of the actuator 32, the actuator 32 extends, such that the piston 34 progressively moves towards the pressure chamber 37.

With a first elongation part h1 of the actuator 32, the piston 34 pushes the plug 50 against the action of the spring 51 until the aperture 49 is closed. In a second elongation part h2 of the actuator 32, of relatively small magnitude, the plug 50 transfers the axial thrust of the piston 34 to the sleeve 41, which then tends to slide axially on the tip 40 towards the atomizer 10 and pressurizes the fuel in the pressure chamber 37. Once a predetermined pressure threshold is reached, which overcomes the preloading of the spring 31, the elongation part h2 ends and the valve needle 12 starts to move.

Then, in a third elongation part h3 of the actuator 32, the fuel in the pressure chamber 37 transfers the displacement of the piston 34 directly to the valve needle 12, consequently opening the nozzle 11 in a proportional manner to perform an injection phase. In other words, the elongation part h3 is effectively that available for defining the stroke of the valve needle 12 that opens the nozzle 11.

A necessary condition for this to happen is that during the elongation part h3, the fuel that seeps through the dynamic seal between the tip 40 and the sleeve 41 is of a negligible amount with respect to the volume swept by the tip 40. This condition occurs if the coupling play of the dynamic seal is sufficiently small and if the time interval in which the elongation part h3 takes place is sufficiently short.

As mentioned above, when the actuator 32 is de-energized, the pressure chamber 37 is open and in communication with the low-pressure environment 22. In fact, the coupling between the sleeve 41 and the spacer 43 does not induce any sealing around the aperture 49 or, advantageously, lateral slits (not shown) are provided to ensure the passage of fuel. Therefore, in this operating condition, fuel can freely enter and leave through the aperture 49. Any variations in the axial size of the valve needle 12 (due to thermal gradients and/or pressure variations in the high-pressure environment 16,18) cause a displacement of the tip 40, which causes a change in volume of the pressure chamber 37 and therefore free transfer of fuel through the aperture 49. In other words, if the valve needle 12 lengthens, the pressure chamber 37 empties; if the valve needle 12 shortens, fuel enters the pressure chamber 37 due to depression.

Therefore, in the presence of elongation of the valve needle 12, undesired opening of the nozzle 11 does not occur, as the tip 40 can freely retract in the sleeve 41 and reduce the axial size of the pressure chamber.

When the actuator 32 is de-energized, the aperture 49 enables achieving automatic compensation even in the presence of relatively rapid changes in the axial length of the valve needle 12 (as a rule, due to variations in fuel supply pressure and pressure variations in the combustion chamber 3).

In the embodiment in FIG. 5, the sleeve 41 is devoid of the flange 48 and is fastened to the inside of the injector body 4, for example by a threaded ring 86 screwed on the injector body 4.

According to a variant that is not shown, the pressure chamber is laterally delimitated by an inner surface of the injector body 4, without providing any additional sleeve.

At the same time, the piston 34 defines an internal cavity 61 that communicates with the low-pressure environment 22, for example through slots 62 made in the lateral wall of the piston 34. The cavity 61 is able to communicate with the pressure chamber 37 through a aperture 59, which has the same function as aperture 49 and is axially made in an end portion 63 of the piston 34. The end portion 63 engages, in an axially sliding manner, a jacket 64 defined by an end portion of the sleeve 41 and axially delimits the pressure chamber 37 on the opposite side with respect to the tip 40.

The sliding zone between the sleeve 41 and the tip 40 and the sliding zone between portions 63 and 64 respectively define dynamic seals to ensure the fluidic sealing of the pressure chamber 37.

Preferably, end portion 63 has an outer diameter greater than that of the tip 40, such that the pressure chamber 37 causes an amplification of the axial movement of the valve needle 12 with respect to that of the piston 34.

The pressure chamber 37 house a plug 70 defined by a piece that is separate from the piston 34, is axially movable with respect to the piston 34 and keeps the aperture 59 closed under the action of a spring 69, preferably arranged between the plug 70 and a cage 71 fastened to portion 63 in the pressure chamber 37.

Regarding the operation of the hydraulic connection 36 in FIG. 5, when the actuator 32 is de-energized, the spring 82 keeps the piston 34 pressed against the actuator 32. Preferably, the spring 82 is coupled on one side to an outer flange of the piston 34 and on the other side to the threaded ring 86. Alternatively, the spring 82 could be coupled to a shoulder of the injector body 4, or could be arranged in the pressure chamber 37 between portion 63 and the sleeve 41.

The spring 69 always keeps the plug 70 in the closed position when the actuator 32 is de-energized. The pressure of the fuel in the pressure chamber 37 is equal to that of environment 22, and so is not sufficient to overcome the action of spring 31. The valve needle 12 thus remains in the closed position.

Plug 70 operates immediately against the thrust of spring 69 to open aperture 59 when the actuator needle 12 is subjected to relatively rapid shortening, for example in the case where the pressure in the high-pressure environment drops significantly. In fact, a depression is generated in the pressure chamber 37 that tends to suck fuel from cavity 61.

Excitation of the actuator 32 causes its elongation, which in turn makes the piston 34 move towards the tip 40. The movement of the piston 34 causes a rapid increase in fuel pressure in the pressure chamber 37, until a threshold value is reached that overcomes the preloading of spring 31.

Immediately afterwards, the valve needle 12 moves with a displacement that is amplified with respect to that of the piston 34, with a transmission ratio defined by the ratio between the areas of the axial faces of portion 63 and the tip 40.

It is evident from the foregoing that the injector 1 enables injecting fuel with a so-called mixed mode, i.e. an HCCI mode (or a mode close to HCCI) at low and medium operating loads, with high and uniform atomization, and in a so to speak "traditional" mode at high operating loads, with high fuel penetration in the combustion chamber 3. In fact, by progressively moving outwards, the valve needle 12 enables achieving a discharge section 14 that progressively grows in a continuous manner proportional to the opening stroke of the valve needle 12. Thus, by an actuator 32 having a displacement response proportional to an electric command signal received from the electronic control unit 33 and the hydraulic connection 36 that effectively defines a direct drive between piston 34 and valve needle 12 when the pressure chamber 37 is pressurized, it is possible to determine the degree of opening of the nozzle 11 with precision, by supplying an electric command signal of corresponding magnitude to the actuator 32 and therefore determine not only the amount of fuel injected, but also the mode of operation.

Furthermore, thanks to the annular passageway 16, fuel does not have to pass through micro-holes and/or inside the valve needle 12 in order to be injected and so coking phenomena are reduced, with consequent advantages in metering accuracy and uniformity of the injected fuel.

As the axial height and therefore the volume of the pressure chamber 37 vary automatically with the hydraulic connection 36, the opening stroke and the axial position of the valve needle 12 are not affected by the relatively slow variations in axial length due to thermal gradients, nor by the axial play due to assembly errors, machining tolerances, wear, etc. According to the present invention, with respect to solutions of the known art, operation of the hydraulic connection 36 is insensitive to the pressure variations that normally occur in the fuel supply as it is placed in the low-pressure environment 22.

Furthermore, thanks to the aperture 49, the hydraulic connection 36 is also able to compensate those relatively rapid variations in axial length of the valve needle 12 induced by pressure variations, which occur in the high-pressure environment 16,18 due to the fuel supply and/or which occur in the combustion chamber 3 on each engine cycle.

In particular, when the nozzle 11 is closed, if the pressure in the high-pressure environment 16,18 increases, the valve needle 12 lengthens and pushes fuel into the pressure chamber 37. This fuel exits freely through aperture 49, and so the valve needle 12 does not move outwards and therefore does not open the nozzle 11. In other words, no false opening of the nozzle 11 takes place.

When even considering the condition in which the nozzle 11 is closed, if the pressure in the high-pressure environment 16,18 drops, the valve needle 12 shortens, and so the volume of the pressure chamber 37 tends to increase. In this case the pressure in the pressure chamber 37 tends to drop and suck fuel through the aperture 49 or 59.

When the nozzle 11 is open, the aperture 49 or 59 is closed and the pressure chamber 37 is pressurized, and so variations in length of the valve needle 12 are compensated by just the seepage through the dynamic seals (between sleeve 41 and the tip 40; and between portions 63 and 64).

Plug 50 operates after a relatively short first elongation part h1 of the actuator 32 to close the aperture 49 and immediately afterwards the direct transmission of axial motion from the piston 34 to the valve needle 12 through the compression of fuel in the pressure chamber 37 is achieve.

In the solution shown in FIG. 5, it is possible to obtain an advantageous amplification of the axial motion of the valve needle 12, and so avoid the use of an excessively bulky actuator 32.

Finally, it is clear that the various specific characteristics of the hydraulic connection 36 enable obtaining solutions that are relatively simple to manufacture and assemble and that, at the same time, operate efficaciously.

Various modifications to the described embodiments will be evident to experts in the field, while the generic principles described can be applied to other embodiments and applications without departing from the scope of the present invention, as defined in the appended claims.

For example, the pressure chamber 37 might not be provided with any port, but communicate with the low-pressure environment only through the dynamic seals (between the tip 40 and the sleeve 41, etc.).

Furthermore, apertures 49 and 59 could be substituted by ports made in the lateral wall of the pressure chamber 37 and which are opened/closed by the axial sliding of portion 63 of the piston 34 with respect to the sleeve 41 (in the case of the solution in FIG. 5), or by the axial sliding of the sleeve 41 with respect to end 41 (in the case of the solution in FIG. 4). In the case of this last variant, the piston 34 could be fixed with respect to the sleeve 41 and, in practice, no plug would be provided.

Furthermore, an adjustable choke could be provided in the lines 24 to enable varying the low pressure level in environment 22 and therefore in the pressure chamber 37, for example in a range between 2 and 6 bar, for providing adjustment for the amount of fuel that enters/exits with respect to the pressure chamber 37.

Therefore, the present invention should not be considered as limited to the embodiments described and illustrated herein, but is to be accorded the widest scope consistent with principles and characteristics claimed herein.

The invention claimed is:

1. A fuel electro-injector for a fuel injection system for an internal combustion engine, the electro-injector comprising:

an atomizer comprising: a) a nozzle defining a sealing seat; and b) a valve needle extending in said nozzle along a longitudinal axis and axially sliding from a closed position, in which it is coupled to said sealing seat, for performing an opening stroke in an outward direction and opening said nozzle; said sealing seat and said valve needle defining a discharge section, which is annular and has a width that continuously increases as the opening stroke of said valve needle proceeds;

an electric actuator suitable for being excited by an electric command signal to cause the opening stroke of said valve needle and defining an axial displacement that is proportional to the magnitude of said electric command signal;

an inlet suitable for being connected to a high-pressure fuel supply;

a high-pressure space for supplying fuel from said inlet to said discharge section;

an outlet suitable for being connected to a low-pressure return system, and a low-pressure space directly communicating with said outlet; and a hydraulic connection arranged between said electric actuator and said valve needle for transmitting motion from said electric actuator to said valve needle, the hydraulic connection comprising a pressure chamber, which is axially delimited, on one side, by said valve needle and, in use, is filled with fuel that, once compressed, exerts an axial thrust, in the outward direction, on said valve needle to cause said opening stroke;

wherein said high-pressure space comprises an annular passageway defined between a lateral outer surface of said valve needle and an inner surface of said nozzle and axially ending at said sealing seat;

wherein said low-pressure space comprises a portion that is arranged axially between said hydraulic connection and said annular passageway and is separated from said high-pressure space by means of a dynamic seal, defined by a coupling zone between said valve needle and a fixed guide portion;

wherein said hydraulic connection is arranged in said low-pressure space, such that said pressure chamber communicates only with said low-pressure space; and wherein the fuel electro-injector is configured such that movement of the valve needle of the atomizer in the outward direction, from the closed position to an open position, includes movement of the valve needle away from the electric actuator.

2. The electro-injector according to claim 1, wherein said pressure chamber has an aperture that is open, or which can be opened, when said electric actuator is de-energized to place said pressure chamber in communication with said low-pressure space, and is closed during a certain part of the displacement caused by said electric actuator to enable the pressurization of the pressure chamber.

3. The electro-injector according to claim 2, further comprising a spherical plug that closes said aperture under the thrust of first elastic means when said electric actuator is not energized.

4. The electro-injector according to claim 2, wherein said aperture is open when said electric actuator is not energized.

5. The electro-injector according to claim 3, wherein said aperture is arranged on the axially opposite side with respect to said valve needle.

6. The electro-injector according to claim 4, further comprising a second plug, which is coaxial with said aperture, is axially set apart from said aperture when said electric actuator is de-energized, and is axially movable in response to the action of said electric actuator to close said aperture.

7. The electro-injector according to claim 6, wherein said hydraulic connection comprises: a sleeve, which laterally delimits said pressure chamber, is axially movable and is fitted for axially sliding on an axial tip of said valve needle; second elastic means that exert an axial thrust on said sleeve in a direction opposite to the axial tip of said valve needle; said aperture being defined by said sleeve.

8. The electro-injector according to claim 7, wherein said second elastic means comprise a first spring coupled, on one side, to said sleeve and, on the other side, to a fixed axial shoulder.

9. The electro-injector according to claim 7, wherein said valve needle comprises a needle, defining said annular passageway and said discharge section, and a transmission rod, axially resting against said needle; said second elastic means comprising a second spring coupled, on one side, to said sleeve and, on the other side, to said transmission rod.

10. The electro-injector according to claim 6, further comprising a piston operated by an end of said electric actuator and coaxial with said second plug; said second plug being a separate piece from said piston; a spring being provided to push said plug axially to rest against said piston.

11. The electro-injector according to claim 6, further comprising a piston operated by one end of said electric actuator, said second plug being defined by an axial end of said piston.

12. The electro-injector according to claim 10, wherein said second plug comprises a semi-spherical portion able to close said aperture.

13. The electro-injector according to claim 1, further comprising a piston operated by one end of said electric actuator and axially ending with a thrust portion, which axially delimits said pressure chamber on the opposite side with respect to said valve needle and engages a lateral wall of said pressure chamber in an axially sliding manner, said thrust portion having an axial face of larger area with respect to that of said valve needle to generate a displacement amplification.

14. The electro-injector according to claim 3, further comprising a piston operated by one end of said electric actuator and axially ending with a thrust portion, which axially delimits said pressure chamber on the opposite side with respect to said valve needle and engages a lateral wall of said pressure chamber in an axially sliding manner, said aperture being made in said thrust portion, said piston being equipped with at least one slot that puts said aperture into communication with said low-pressure space.

15. The electro-injector according to claim 1, wherein said electric actuator is a piezoelectric actuator or a magnetostrictive actuator.

16. The electro-injector according to claim 1, wherein said coupling zone has a diameter equal to the mean diameter of said sealing seat.

* * * * *